US006098836A

United States Patent [19]

Gottselig

[11] Patent Number: 6,098,836

[45] Date of Patent: Aug. 8, 2000

[54] WET HYGIENIC TOWEL DISPENSER

[76] Inventor: John C. Gottselig, 510 S. Lincoln St., Wilmington, Del. 19805

[21] Appl. No.: 09/050,735

[22] Filed: Mar. 30, 1998

Related U.S. Application Data

[63] Continuation-in-part of application No. 08/838,564, Apr. 9, 1997, Pat. No. 5,765,717, which is a continuation of application No. 08/432,677, May 2, 1995, abandoned, which is a continuation-in-part of application No. 08/127,438, Sep. 27, 1993, abandoned, and a continuation of application No. 07/893,343, Jun. 3, 1992, Pat. No. Des. 347,534.

[51] Int. Cl.[7] ..... A47K 10/24

[52] U.S. Cl. ..... 221/45; 206/204

[58] Field of Search ..... 221/33, 45, 46, 221/63; 206/233, 204, 812

[56] References Cited

U.S. PATENT DOCUMENTS 5,501,323 3/1996 Denesha et al. ..... 221/63
5,660,313 8/1997 Newbold ..... 206/233

*Primary Examiner*—Kenneth W. Noland

[57] ABSTRACT

Wet towelette dispensers are provided which include a roll of moistened, flushable towelettes disposed in a sealable housing which has a slotted opening therein for permitting the removal of one more of the towelettes from the dispenser in a manner similar to the way dry toilet paper is typically dispensed. A sealing blade and receiving groove are positioned in the slotted opening to prevent the towelettes from drying. The housing may include a lid for replacing the roll of towelettes. The sealing blade may further be positioned along the edge of the lid and a groove positioned along the housing to seal the interior compartment containing the roll of towelettes.

12 Claims, 10 Drawing Sheets

WET HYGIENIC TOWEL DISPENSER

CROSS REFERENCE TO RELATED APPLICATION

This application is a Continuation-in-Part of Utility patent application Ser. No. 08/838,564, filed on Apr. 9, 1997, now U.S. Pat. No. 5,765,717, which is a continuation of Ser. No. 08/432,677, filed May 2, 1995, now abandoned, which is a Continuation-in-Part of Utility patent application Ser. No. 08/127,438, filed on Sep. 27, 1993, now abandoned, which is a Continuation-in-Part of Design patent application Ser. No. 07/893,343, filed on Jun. 3, 1992, now U.S. Pat. No. Des. 347,534.

FIELD OF THE INVENTION

This invention relates to the field of hygienic tissues and paper products for use in a bathroom, kitchen or public facility and more particularly, to containers for housing pre-moistened or moistenable towelettes disposed in roll form.

BACKGROUND OF THE INVENTION

Flushable, pre-moistened, sanitary wipes have been available in the marketplace since at least the mid 1970's, and typically comprise a web of soft, fibrous material, such as tissue paper, bonded together with a reinforcing layer that contains a water-dispersible material. The web is often patterned and cut into napkin-sized towelettes. A stack of these towelettes is then moistened and protected from evaporation in a sealable plastic container. Pre-moistened towelettes can be stored for lengthy periods of time, even periods exceeding a year.

When intended for use in and around the bathroom, for example, as toilet paper or a baby wipe, premoistened tissue has to be pliable enough to permit easy disposal within the vortex of a toilet bowl ("flushability"), but also has to have sufficient strength to be useful in abrasive hygienic applications ("wet strength"). In other applications, such as kitchens, health clubs or like facilities, however, flushability is less important. Another desirable property for the towelettes is "biodegradability"; in other words, the towelettes have to be capable of being decomposed by natural biological processes in, for example, sanitary sewer systems or landfills.

One popular, pre-moistened tissue material is disclosed in Grach et al., U.S. Pat. No. 3,881,210 (hereby incorporated by reference), and is believed to be sold by Scott Paper Company, under the trademarks "SOFTKINS", "WET WIPES" and "COTTONELLE." The pre-moistened wipes of Grach et al. contain a reinforcing layer containing a thin film of polyvinyl alcohol and water-dispersible polyvinyl acetate. This reinforcing layer is laminated to a web of soft, fibrous material, and the resultant product is pre-moistened to a moisture content of about 100–350 wt. %. Upon flushing these tissues, the reinforcing layer is dispersed in the water vortex of the toilet so that it can be readily disposed of without clogging the plumbing.

Once a solution to the problem of preparing a flushable soft web that has sufficient wet strength to be used as a sanitary towelette was solved, artisans quickly sought a dispenser for placing a multiplicity of these towelettes in the bathroom or nursery. Initially, a stack of the pre-moistened towelettes was inserted into a simple rectangular box having a hinged lid. It soon became apparent, however, that opening the sealed lid and removing a single wipe from a moistened stack required a certain amount of manual dexterity and patience. In addition, a certain amount of drying took place on the opening of the box.

More convenient means for housing and accessing wet towelettes were later developed in an attempt to solve these problems. See Phillips, U.S. Pat. No. 4,978,095, Boone, U.S. Pat. No. 4,106,617 (Boone '617), and Boone, U.S. Pat. No. 3,837,595 (Boone '595) all of which are hereby incorporated by reference. In Phillips and certain embodiments of Boone '595, a roll of wet towelettes was provided, the roll being arranged, in a vertical position and towelettes were then removed from the center of the roll by twisting one or more towelettes at a time through a central opening of a vertically-positioned cylindrical container. In Boone '617, a wet towelette dispenser was described which could be alternatively mounted in a conventional dry toilet paper holder or by means of mounting arms associated with a dry toilet paper spindle posterior to a roll of dry toilet paper. Boone '595 also discloses an embodiment using a horizontally held roll of wetted sheets. A leading area of the sheet material extends through a slot, such as an incision, extending lengthwise in the container. The container is formed of a thin plastic material which is stated to provide a resilience in the wall portion in which the incision is formed. An exterior flap member biased toward the wall of the container is used to provide a seal. In addition to the containers described in Boone '595, Boone '617 describes both a horizontally positioned cylinder and box-like wet towelette dispenser. Horizontal stability is provided to the dispensers by means of positioning appendages or legs extending inwardly from the mounting arms and resting against the wall of the bathroom or the like on which the dispenser is mounted.

The devices disclosed by Phillips and Boone have not, however, been commercially implemented for "WET WIPES" type products. Some of the reasons for this could be the fact that they are inconvenient to set up and use, or they require additional hardware which is not readily adapted for use in a conventional bathroom.

SUMMARY OF THE INVENTION

This invention relates to biodegradable, pre-moistened or "moistenable" towelettes and sealable dispensers for containing this type of tissue.

Dispensers of this invention contain a roll of substantially biodegradable pre-moistened or moistenable towelettes, or wipes, which are easily separable from each other along perforated lines, and which have high degree of wet strength, and are preferably readily flushable or dispersible in a toilet vortex. The towelettes may be made of recycled fibers.

The dispenser may house a container component in which liquid may be placed to wet the moistenable towelettes or to keep moistened towelettes from going dry. In an embodiment of the invention, the moistenable towelette roll is provided in a dry condition and once in the dispenser is wetted by a liquid added to the container. Such wetting can be accomplished by a wick disposed such that it wicks liquid from the container to the roll of moistenable towelettes. The wick is preferably made of material and mechanically positioned such that, the wick is maintained in contact with the moistenable roll as towelettes are removed from the moistenable towelette roll.

The roll of pre-moistened or moistenable towelettes is disposed in a substantially-sealable housing so that the towelettes are in a position for convenient dispensing and use and so that the wetted towelettes do not loose significant moisture. Preferably the housing should be capable of preventing pre-moistened towelettes from substantially losing their moisture by evaporation for at least 3–6 months. The housing is provided with a slotted opening for permitting the removal of one or more towelettes at a time. The slotted opening is preferably sealed using a sealing blade. The slotted opening in the housing preferably comprises an upper lip holding the sealing blade and a lower lip having a recessed groove for receiving the blade. The upper and lower lips may be shaped in a "V" angle relative to a longitudinal axis of the housing, allowing the sheets to be torn into a "V" pattern—preferably the sheets will include corresponding "V" patterned perforations. The sealing blade material is selected as to be of such resilience that the sealing blade bears firm against the towelette material and recessed groove of the lower lip when a towelette is not being pulled from the dispenser, but which permits the towelette to be removed from the dispenser when it is pulled. One or more sets or rows of teeth may be provided, preferably angled away from the container, for retaining the free end of the roll of pre-moistened or moistenable towelettes in proximity to the slotted opening to avoid having the free end of the roll of towelettes recede or slide back into the container. A serrated-edge may also be affixed on the housing near the slotted opening to aid in separating the towelettes. In a preferred embodiment, the housing may further comprise a flip-top or hinged "access" opening for inserting a towelette roll into the dispenser, thereby allowing for refillable dispensers.

The towelettes of this invention may be wetted with a liquid containing water, alcohols (e.g. ethanol and propanol), condensation products of aliphatic alcohols and ethylene oxide, emollients (such as hydrophilic petrolatum), protectants (such as dimethicone and lanolin), lubricants (such as mineral oil), anionic, cationic or non-ionic surfactants (such as dialkyl sodium sulfosuccinates, quaternary ammonium salts, and stearyl alcohols, respectively), polymeric dispersing agents (such as polymeric polycarboxylates), anionic, cationic, non-ionic, colloidal or other type of emulsifiers (such as triethanolamine stearate, cetyltrimethylammonium bromide, polyoxyethylene fatty alcohol ethers, acacia, and magnesium hydroxide, respectively), anti-bacterials (such as boric acid and polymixin B sulfate), antifungal agents (such as miconazole), other medicinal agents (such as antihemorrhoidal agents) and/or perfumes.

Accordingly, this invention provides wet towelettes in a manner which most clearly resembles the dispensing of dry toilet tissue or paper towels from a roll. Instead of wrestling with the problem of a wet towelette that has been funnelled through a tiny opening in a vertically disposed tube and erratically folded onto itself like a "rope", the towelettes of this invention can be neatly rolled up in the same manner that dry toilet tissue is now provided. The rolls can also be manufactured with no cardboard insert—thus allowing for more paper per roll and less cardboard waste. This is possible due to the presence of one or more rollers in the container.

The dispensers of the present invention may be mounted to existing fixtures such as a paper towel bracket or dry toilet tissue roll hardware, such as spindle-type dry toilet paper roll brackets, without the need for straps or expensive additional fixtures or hardware.

In an embodiment preferred for use with dry toilet tissue hardware at least one spring-loaded button or extension is provided on one of the axial ends of a cylindrical housing to provide a dispenser which can be easily inserted between a pair of arms of an ordinary toilet tissue bracket. In a preferred embodiment, the spring-loaded extension apparatus comprises a spring-loaded button surrounded by a plurality of threaded rings which can be removed individually to incrementally reduce the size of the button. In an embodiment preferred for use with paper towel bracket-type hardware, the housing is provided with cylindrical indentations at both axial ends of the housing to accept the paper towel brackets.

The housing can be provided with extension tabs which prevent it from rolling when an individual towelette is drawn from the roll through the slotted opening. The housing can also include a serrated edge adjacent the slotted opening for permitting facilitated severing of one or more towelettes from the roll along perforated lines.

Furthermore, in the preferred embodiments of this invention, breakaway or removable extension tabs are affixed to the dispenser to permit substantially flush incidence with the bracket or mounting surface to which the dispenser is attached, thereby minimizing or preventing rotational movement of the dispenser when towelettes are removed from the dispenser. The breakaway extension tabs are generally made from friable material which permits breakage along a notch placed in the tab. The breakaway or removable extension tabs are attached such that they can be removed from the dispenser if they are not needed. The breakaway or removable extension tabs of the present invention may provide for arranging of the same at any angle in order to permit flush incidence with the bracket or mounting surface. The breakaway or removable extension tabs may be provided with an adhesive material to aid in holding the dispenser to the bracket or mounting surface. The removable extension tabs can also be employed by having one or more recessed slots (not shown) in the side of the container and tabs can be inserted at proper angles for flush incidence with the bracket or mounting surface.

In further embodiments of this invention, means are provided for combining both a pre-moistened or moistenable towelette roll and a roll of dry toilet tissue in one dispenser housing, or in two separate housings intimately connected to each other such as to approximate one dispenser (a "dual dispenser"). The dispenser generally is suspended a suitable distance above the floor by coupling of the dispenser to a horizontally disposed, spindle—type dry toilet paper roll bracket. At least one set of breakaway or removable extension tabs are provided on the dual dispenser, at a point in proximity to the dry toilet paper roll bracket, to provide rotational stability of the dispenser when either the dry toilet paper or the pre-moistened or moistenable towelettes are removed from the dispenser.

Preferably, these dual purpose dispensers dispose the rolls on top of one another in a "vertically stacked" arrangement. In a preferred embodiment, the pre-moistened or moistenable roll is placed in a superior position to the roll of dry toilet tissue. A partition may separate such unitary dispenser housing into two separate chambers, one chamber for the dry toilet tissue roll and the other chamber for the pre-moistened or moistenable towelette roll. Regardless of whether the rolls are separated by a partition or not, the pre-moistened or moistenable towelette roll is preferably housed in a substantially sealed housing to limit evaporation of moistening liquid and drying of the towelettes. The chamber for the dry toilet tissue roll may have an open side for inserting the dry toilet paper and a means to keep the paper in place withing the chamber.

BRIEF DESCRIPTION OF THE DRAWINGS

The accompanying drawings illustrate preferred embodiments of this invention.

DETAILED DESCRIPTION OF THE INVENTION

Figure 1:
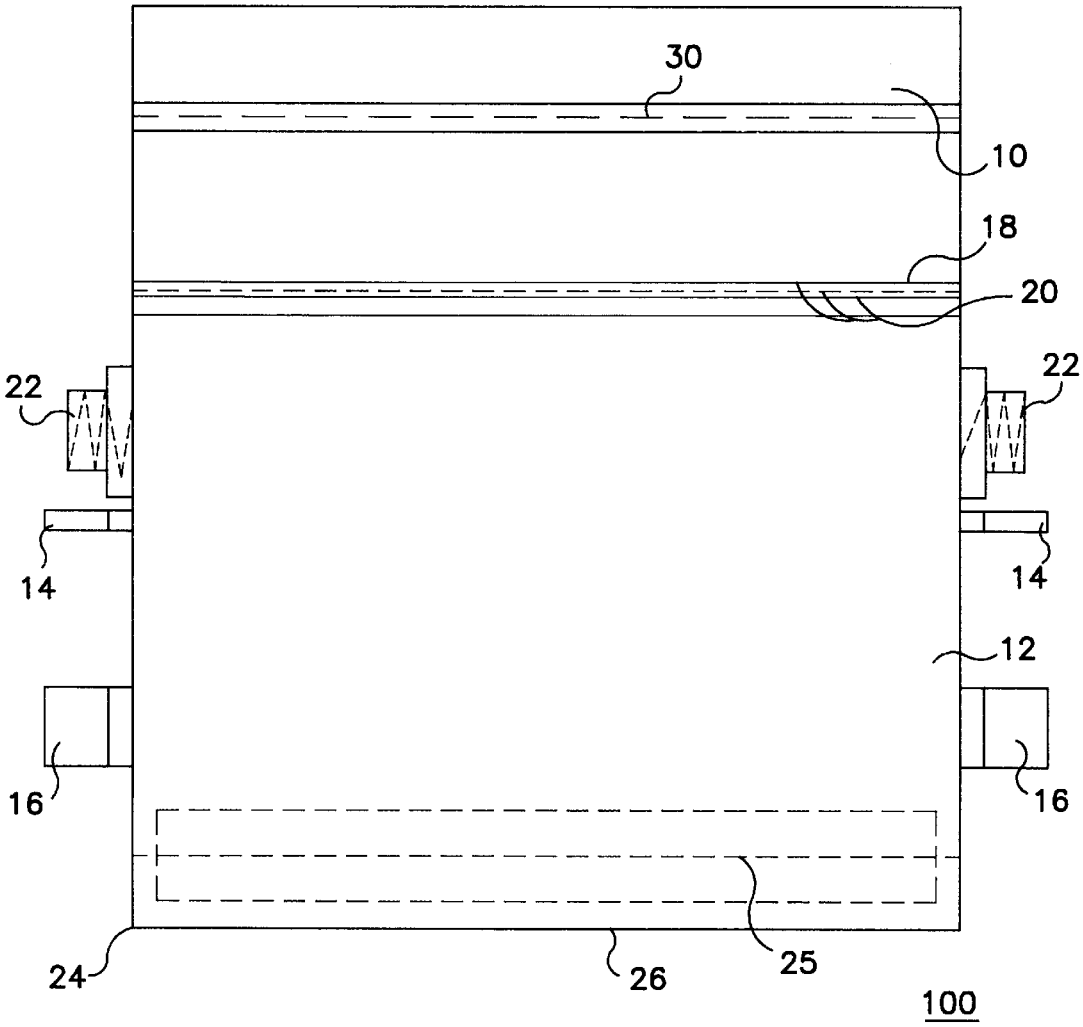
FIG. 1: is a front planar view of a preferred wet towelette dispenser of this invention.
Figure 2:
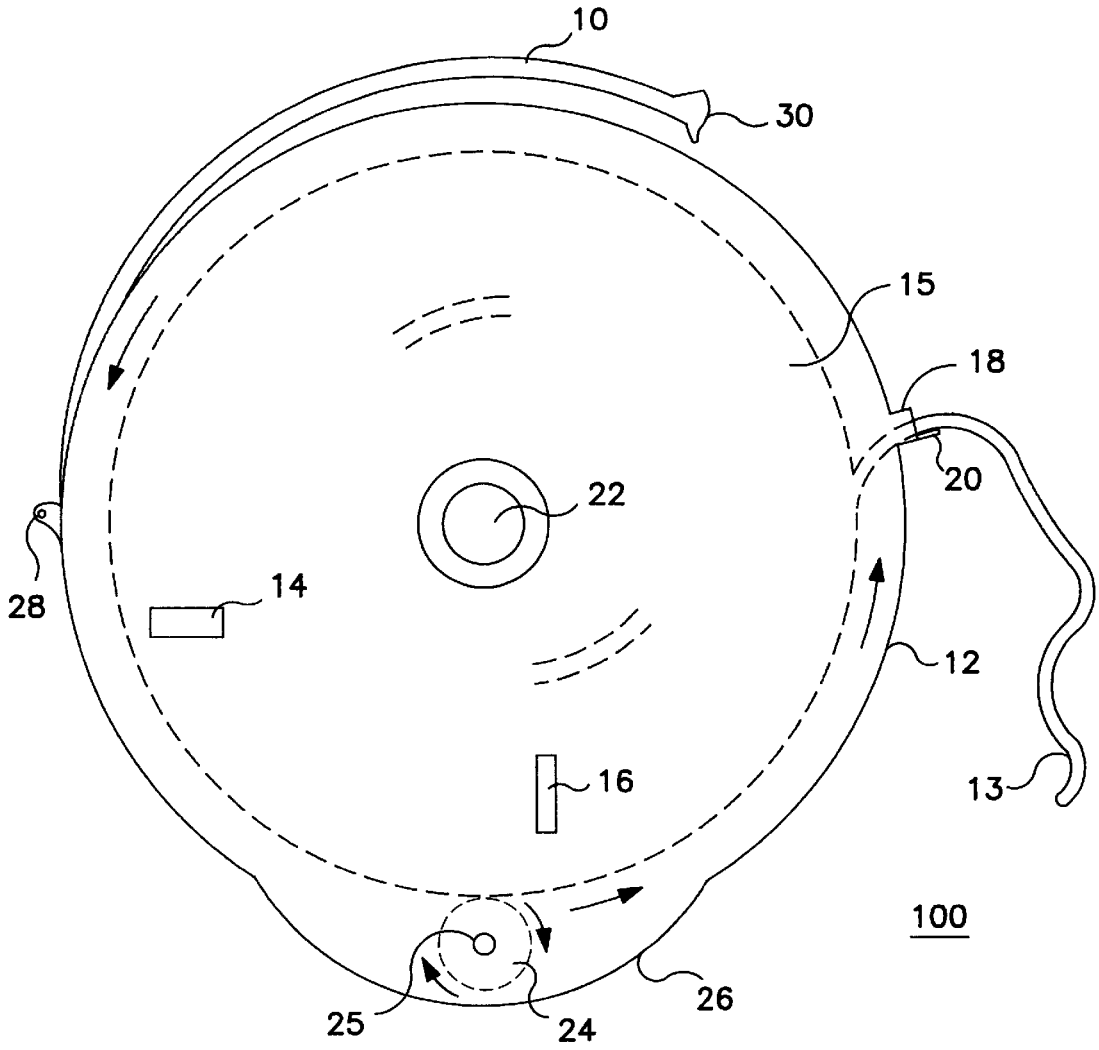
FIG. 2: is a side planar view of a preferred wet towelette dispenser of FIG. 1, illustrating, in phantom, a roll of towelettes, with a single towelette being withdrawn from a slotted opening.

Referring to the figures, and particularly to FIGS. 1 and 2 thereof, there is depicted a wet towelette dispenser 100 which is adapted for being snapped directly between a pair of arms of a typical 5.5 inch dry toilet tissue bracket. This particular dispenser 100 includes a polymeric housing 12 having a hinged lid 10. The lid 10 preferably conforms as closely as possible to the outer configuration of the top of the housing 12. In the side view depicted in FIG. 2, the housing has a circular cross-section and the lid 10 arcs about an upper surface of this circular cross-section. It is envisioned, however, that the housing need not be circular at all, and can exhibit an oblong or even a square or rectangular configuration, so long as the towelettes can be dispensed readily without constricting or inadvertently tearing them.

The housing 12 also preferably contains an opening, ideally a horizontally-disposed slotted opening 18, located on a portion of the housing that faces outward. As discussed below with reference to FIGS. 6–8, the slotted opening 18 can contain a serrated edge 20 for both permitting one or more towelettes 13 to be severed from the roll 15, and to also keep the loose end of the roll 15 from being drawn back in to the dispenser. The slotted opening 18 is described in FIG. 2 as extending outwardly from the curved arc of the housing 12, but it can also be flush with the housing surface. During storage, the slotted opening can be taped closed to prevent evaporation of the pre-moistened towelettes. As discussed below, the slotted opening may contain a sealing blade to prevent evaporation of the towelettes once the system has been put in use, and one or more sets or rows of teeth to prevent the towelettes from traveling back into the housing. A hinged flap (not shown), preferably made of plastic like the housing, can be sealed over the opening to further provide sealing ability.

The dispenser 100 may also include one or more guide rolls 24 located in a lower portion of the housing, and ideally within a definable guide roll cavity 26, which extends from a lower portion of the housing a sufficient distance to permit both the guide roll 24 and the full roll of wet towelettes 15 to move freely within the housing chamber. The guide roll can be designed to rotate freely about a guide roll axle 25 which, in combination with guide roll 24, permits the towelette roll to smoothly operate without impinging significantly against the lower inside surface of the housing 12.

Figure 2A:
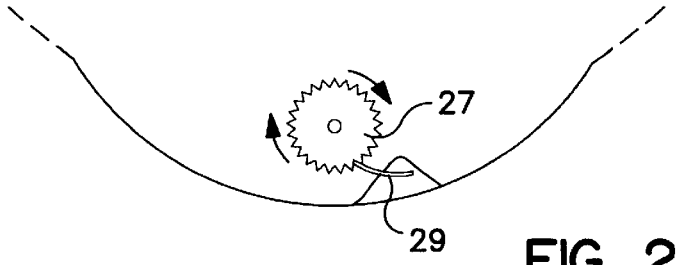
FIG. 2*a*: shows a preferred rotation limiting device for the guide roll shown in FIG. 2.

Although the guide roll is described as having a circular cross-section, it may have a "toothed" or "geared" portion 27, such as the one illustrated in alternative embodiment FIG. 2*a*. Similar to the operation of break tension equipment found in drum brakes used in automobiles, this gear portion could include a directionally-sensitive, rotation limiting device 29. Preferably the gear portion is located within the housing laterally along the axle 25 from the towelette roll so as to not interfere with the smooth rotation of the roll. In operation, as each towelette is removed, the gear would click over one or more teeth in order to ensure that the towelette roll 15 does not slide backwards and withdraw the end of the exposed towelette 13 back into the housing where it is less accessible to a user. Alternatively, the entire guide roll can include a roughened or geared surface for frictionally gripping or "digging" into the towelette roll to more assuredly prevent it from rolling in a reverse direction. Other methods for preventing the towelette roll from rolling backwards will be readily apparent to those of ordinary skill in the art once the remainder of the present invention becomes known.

The preferred dispenser 100 of this invention also include at least one spring-loaded button 22 when used with a toilet tissue bracket, although as depicted, the housing 12 contains two springloaded buttons 22. These buttons will enable simple insertion of the dispenser between a pair of arms of an ordinary toilet tissue bracket. The buttons can be configured in a variety of sizes and shapes to conform to the various commercial brackets on the market. The buttons may also contain a threaded portion which can be removed to provide a smaller button size for brackets that accept small spindles. One version of this button embodiment is described in FIG. 3 in which an outside ring 123 is affixed by threads 127 to interior button 122 to increase its diameter. If a smaller spindle hole is encountered in any particular dry roll bracket, the outer ring 123 an be removed from its threaded engagement with interior button 122. The spring 125, being located within the interior button 122, remains unaffected.

Alternatively, an axial opening can be provided through the container 12 approximately where the buttons 22 are located so that the dispenser 100 of this invention can be disposed along a conventional toilet tissue spindle (not illustrated).

Since the rotation of the towelette roll 15 could provide a rotational force to the housing itself, a set of breakaway or removable extension tabs 14 and 16 can be provided on either side of the housing for impinging against a bathroom wall, cabinet surface, or bracket surface to minimize or prevent housing rotation. In this way, the housing will remain in a stable location in its mounting bracket while individual towelettes are drawn from the slotted opening and severed along serrated edge 20. Although the breakaway or removable extension tabs 14 and 26 can be provided on either side of the housing for impinging against a bathroom wall, cabinet surface, or bracket surface to minimize or prevent housing rotation. In this way, the housing remains in a stable location in its mounting bracket while individual towelettes are withdrawn from the slotted opening and severed along serrated edge 20. Although the breakaway or removable extension tabs 14 and 16 are shown in horizontal and vertical positions, they can be disposed at any angle which permits substantially flush incidence with a bracket or mounting surface. Preferably, the breakaway or removable extension tabs 14 and 16 contain a notch so that they can be easily broken and removed from the housing 12 if they are not needed for service.

Figure 3:
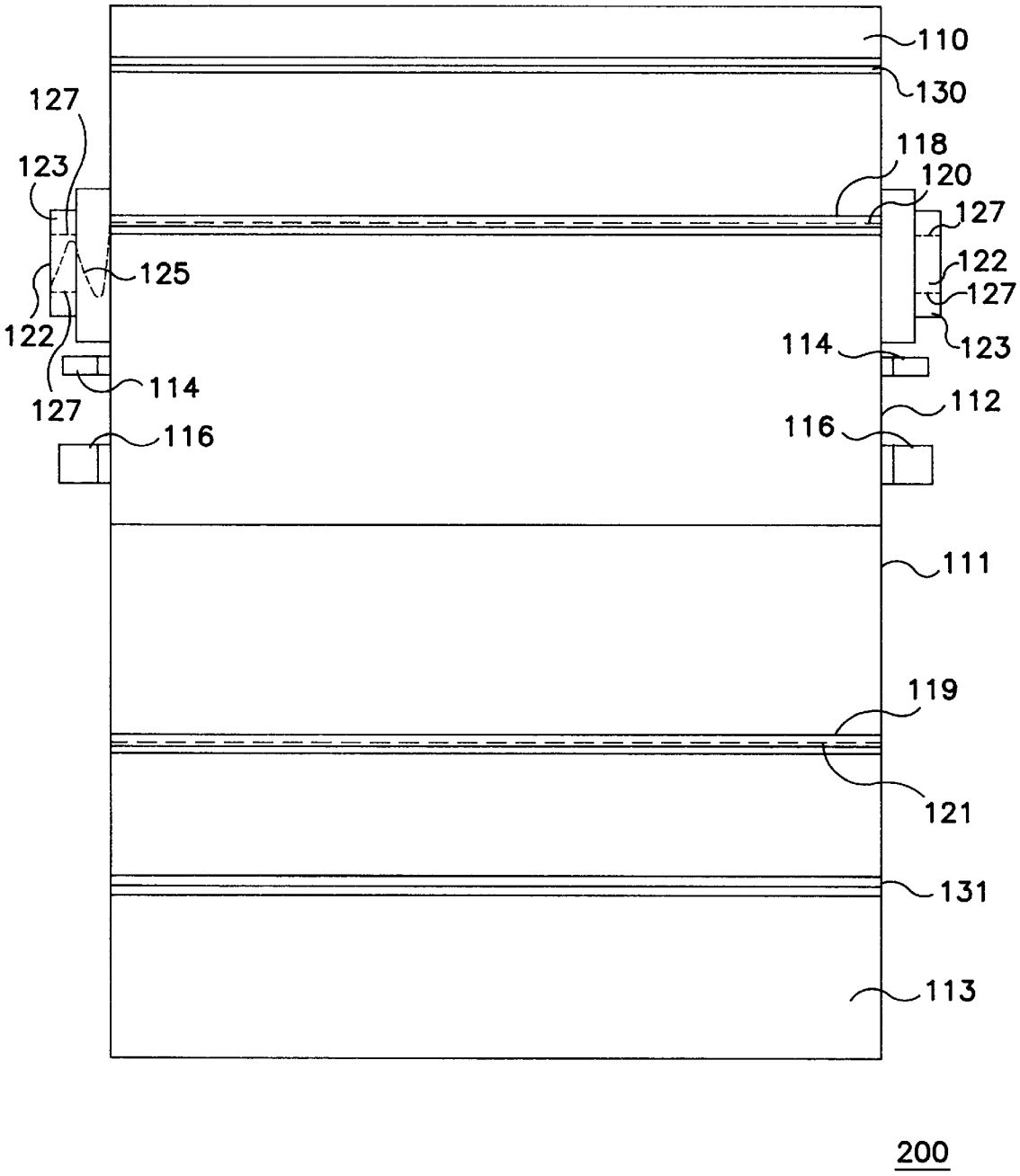
FIG. 3: is a front planar view of a dual roll embodiment of this invention.
Figure 4:
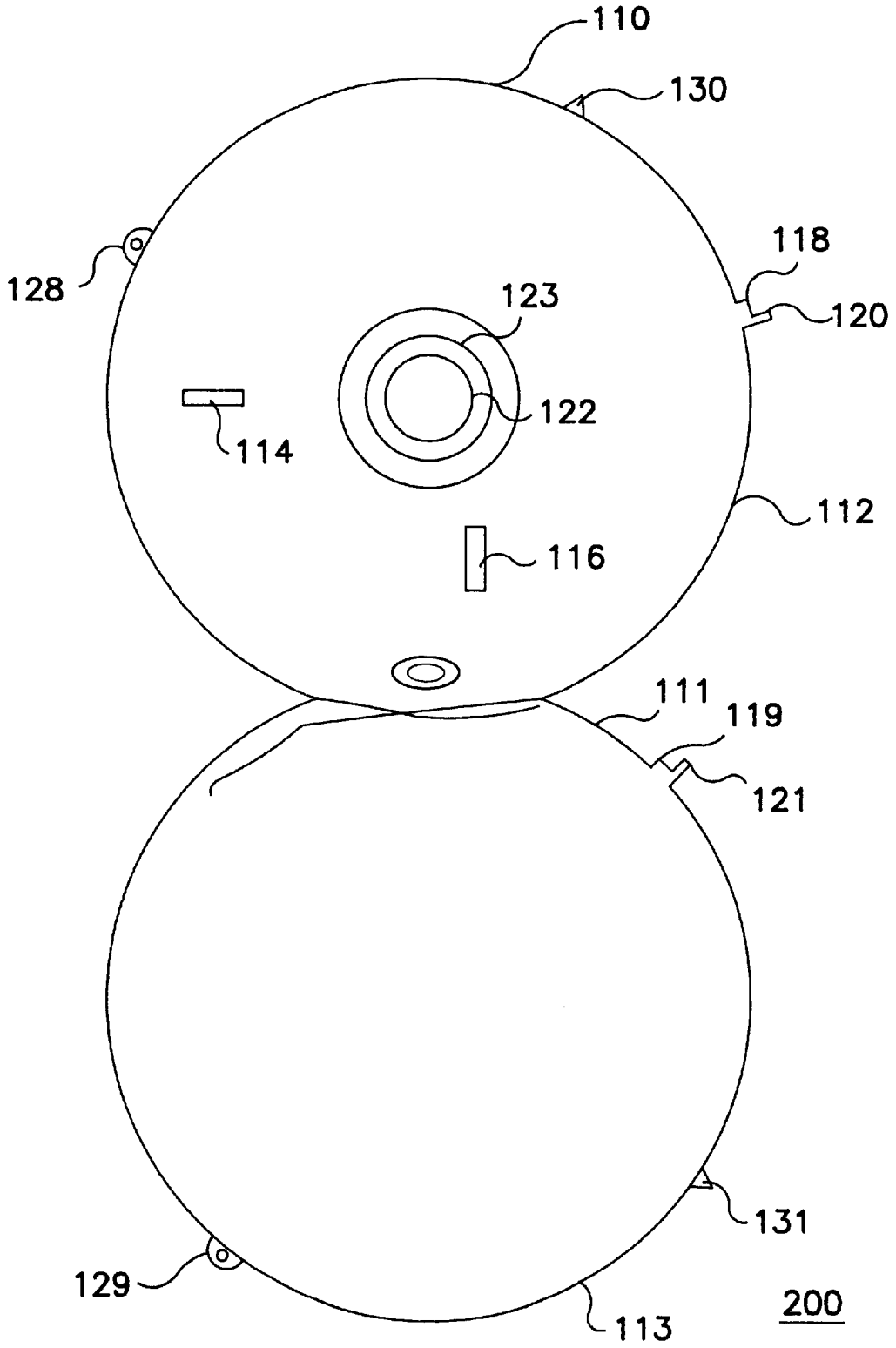
FIG. 4: is a side planar view of the dual roll embodiment of FIG. 3.

With reference to FIGS. 3 and 4, there is shown a preferred dual roll wet towelette dispenser 200. The upper portion of this dispenser 200 is substantially similar to the dispenser 100, but is equipped with an upper housing 111 for holding the roll of premoistened or moistenable towelettes, the lower housing 112 in this embodiment holding a roll of dry toilet tissue so that consumers have the option of using both products alternatively or simultaneously as desired.

Similar to the dispenser 100, the dual roll wet towelette dispenser 200 contains a pair of housings 111 and 112 with at least one substantially air-tight lid 110 equipped with lid latche 130. As shown in the particular embodiment FIG. 4, lids 110 and 113 are located on opposite sides of the dispenser 200 and are equipped with hinges 128 and 129.

Since this dual roll dispenser 200 can be mounted by merely attaching one of the housings, only a single set of breakaway or removable extension tabs 114 and 116 is provided. Although the wet and dry rolls can be inserted alternatively into the upper and lower housings 112 and 111, it is preferred that the upper housing 112 contain the roll of premoistened or moistenable towelettes. Similarly, although a serrated edge 121 is provided in the slotted opening 119, if dry toilet tissue is inserted into the lower housing 111, the serrated edge 121 can be eliminated to save expense.

Figure 4A:
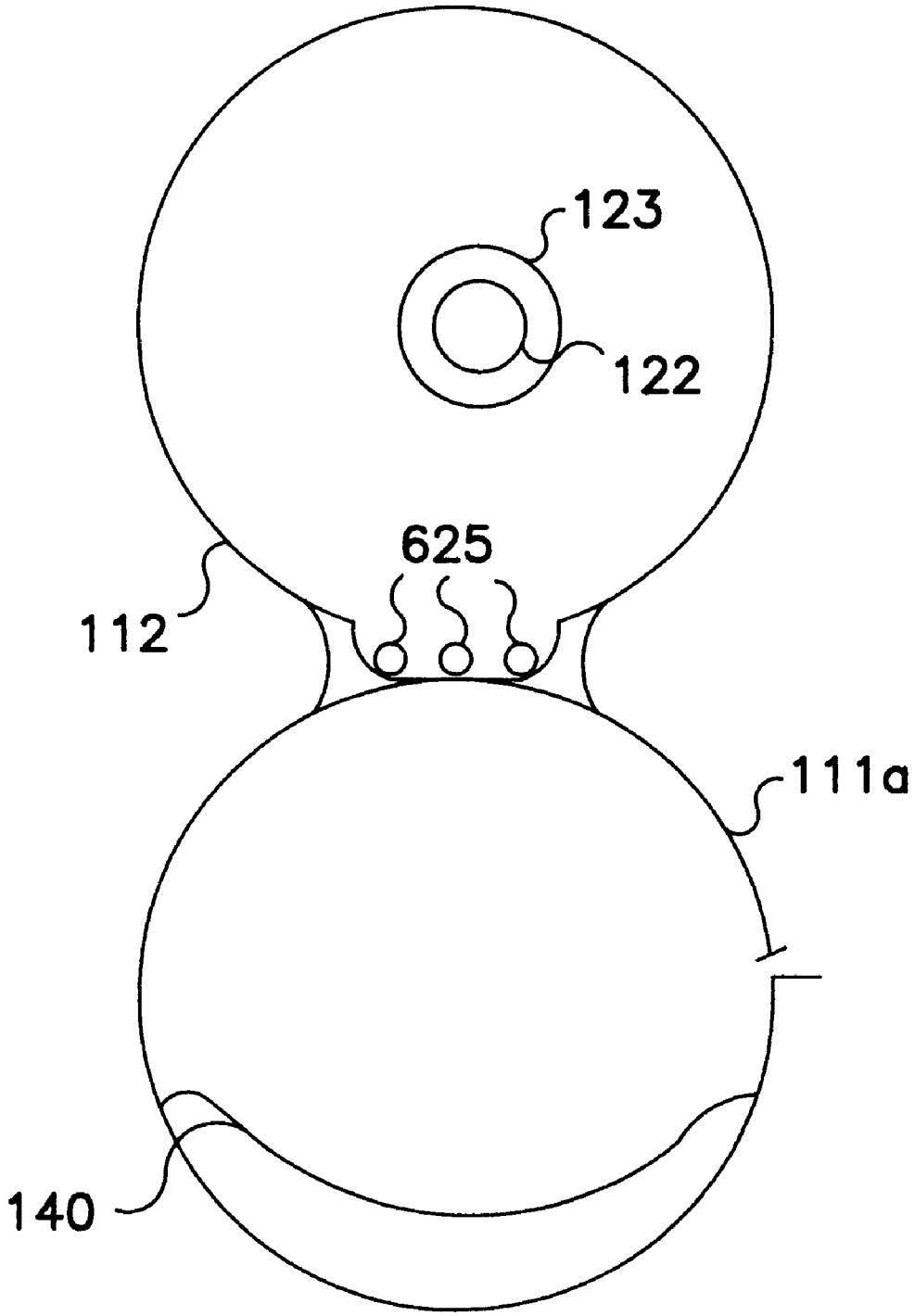
FIG. 4*a*: is a side planar view of an alternate embodiment of the dual roll configuration.

FIG. 4*a* illustrates an alternate embodiment of the dual roll configuration in which the lower housing 111*a* holds dry paper and is open on at least one side. A lip 140 is used placed on the open side to maintain the dry paper in the lower housing 111*a*. Also shown in FIG. 4*a* is the use of three rollers 625 on the bottom of the upper housing 112.

Figure 5:
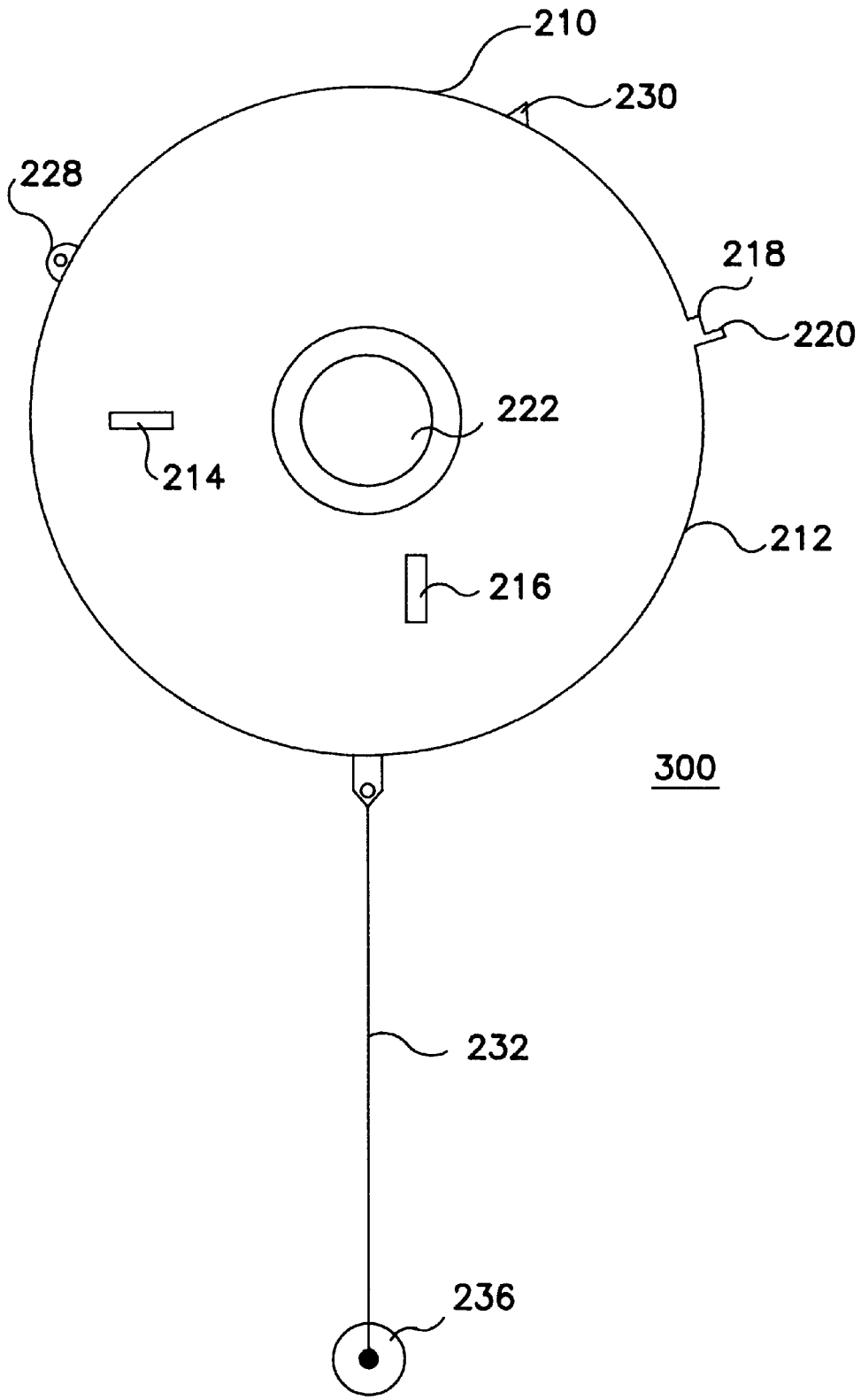
FIG. 5: is a side planar view of an additional embodiment for a dual roll dispenser having a wire supported spindle for holding a dry roll of toilet tissue.
Figure 6A:
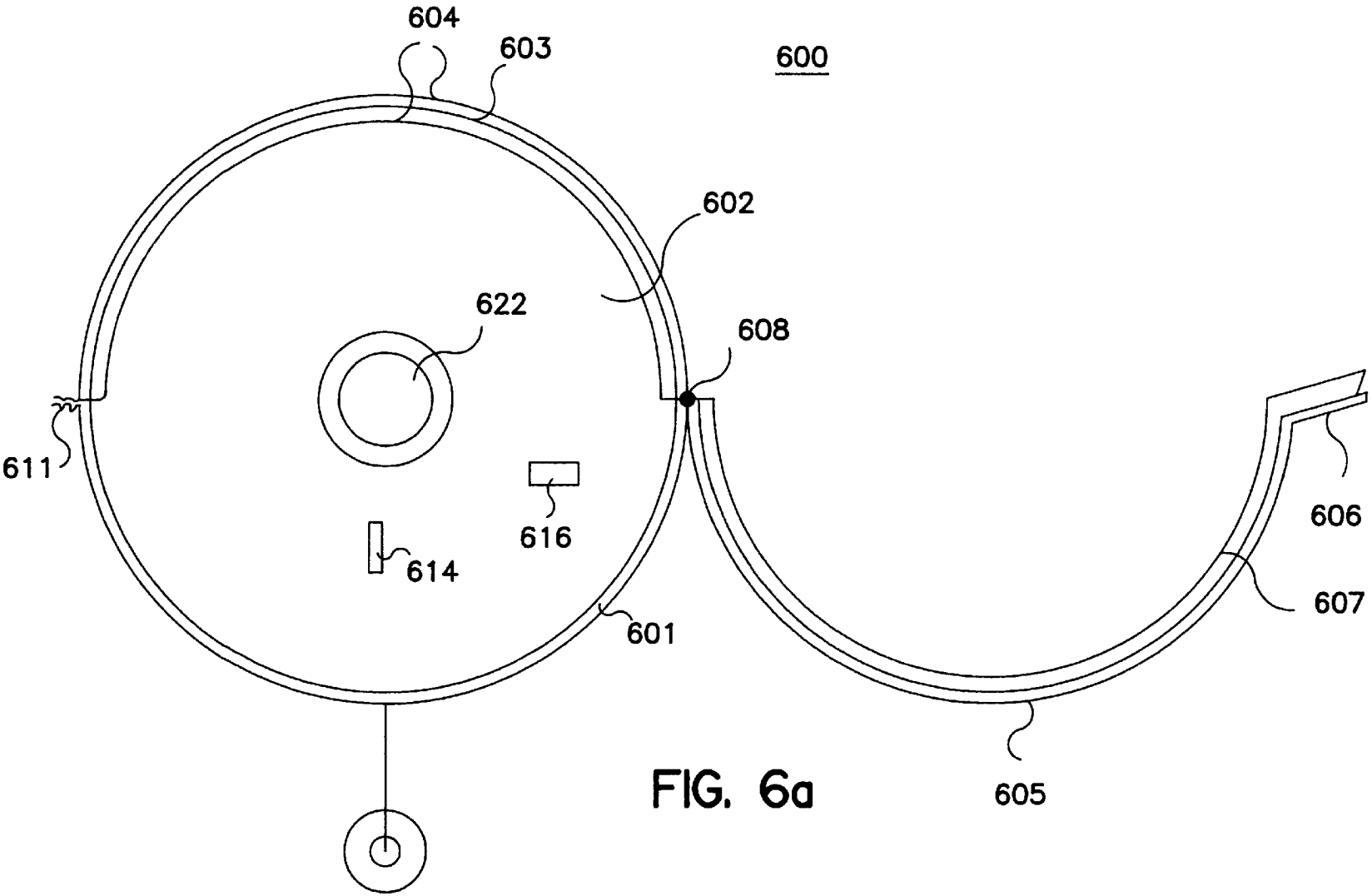
FIG. 6*a*: is a side planar view of a preferred wet towelette dispenser having a flip-top lid for replacing rolls of towelettes.
Figure 6B:
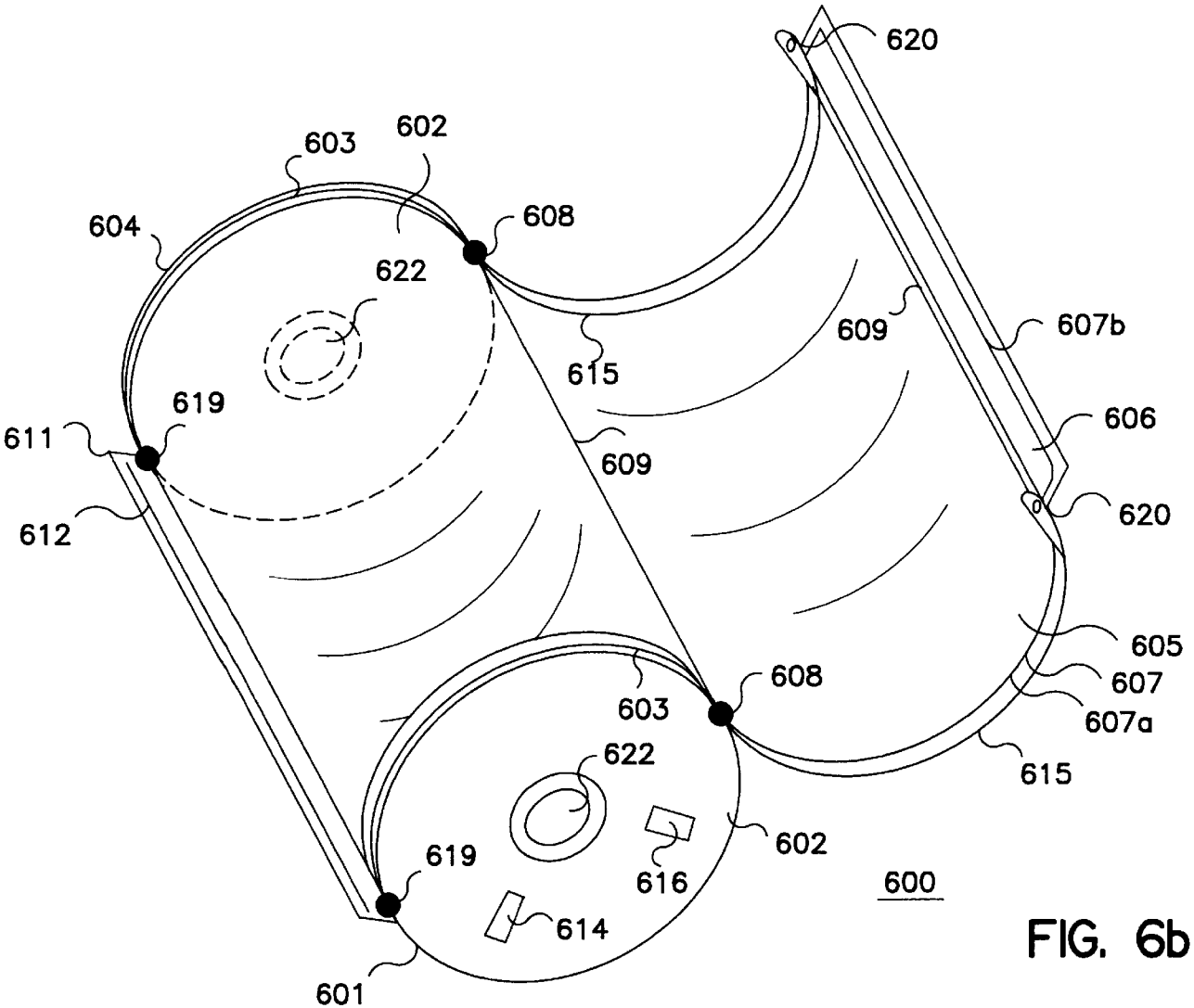
FIG. 6*b*: is a perspective view of a preferred embodiment having a flip-top lid shown in an open position.

In fact, as illustrated in FIG. 5, the entire lower housing can be eliminated and replaced with a rather conventional dry roll hanger 232 and dry roll spindle 236. This dual roll dispenser 300 mounts a dry roll hanger 232 from a lower surface of the polymeric housing 212. The upper housing 212, for containing the wet towelette roll, is substantially similar to dispenser 100, although the drawing has been simplified somewhat to highlight the dry roll hanger 232 development. As with the earlier described dispensers, dispenser 300 preferably contains at least one spring-loaded button 222, a pair of breakaway or removable extension tab sets (two on each side) 214 and 216, a hinge 228, a latch mechanism 230 attached to a lid 210, and a slotted opening 218 having a serrated edge 220. Dry roll hangers are typically rectangular in shape and contain a spindle of sufficient length (typically about 5.5 inches) to be inserted through the cardboard tube or opening of a dry toilet tissue roll. With reference to FIGS. 6*a* and 6*b*, a dispenser 600 having a preferred embodiment of a flip-top lid and sealing mechanism will now be described. The lower portion 601 of dispenser 600 is cylindrically shaped and substantially similar to the lower portion of the housing of dispenser 100. Attached to the lower portion 601 are two side panels 602, each of which include a panel groove 603 along an upper edge 604. One or both of panels 602 will also preferably have a set of breakaway or removable extention tabs 614 and 616. As above, a lower housing or a dry roll hanger may optionally be provided. Protruding from lower portion 601 is a lower lip 611 which preferably has a recessed groove 612 running along the length of the lip 611.

Flip-top lid 605 is preferably shaped like a half cylinder, although, as above, other shapes could be used. Flip-top lid 605 may be secured to lower portion 601 along hinge 609 by two pin members 608 or any of a number of hinging mechanisms known in the art. Protruding from flip-top lid 605 is an upper lip 606. A sealing blade runs along the semi-circular axial edges 615 of flip-top lid 605 and along the length of upper lip 606. Sealing blade 607 is preferably formed from a softer material, and may generally be shaped like an automobile windshield wiper. Panel grooves 603 of side panels 602 and recessed groove 612 of lower lip 611 are positioned to accept the sealing blade 607 when lid 605 is closed. Sealing blade 607 preferably comprises side blade 607*a* and exit blade 607*b*. Side blade 607*a* is preferably firmer than exit blade 607*b*. When closed, upper lip 606 and lower lip 611 form an exit slot allowing the towelettes to be removed, while the sealing blade will press down upon the towelette to prevent drying of the towelettes in the housing. As noted above, in an alternate embodiment upper lip 606 and lower lip 611 may be eliminated in which case the exit blade 607*a* may simply run along the edge 609 of flip-top lid 605, and recessed groove 612 may be included along the edge of the lower portion 601.

Figure 7:
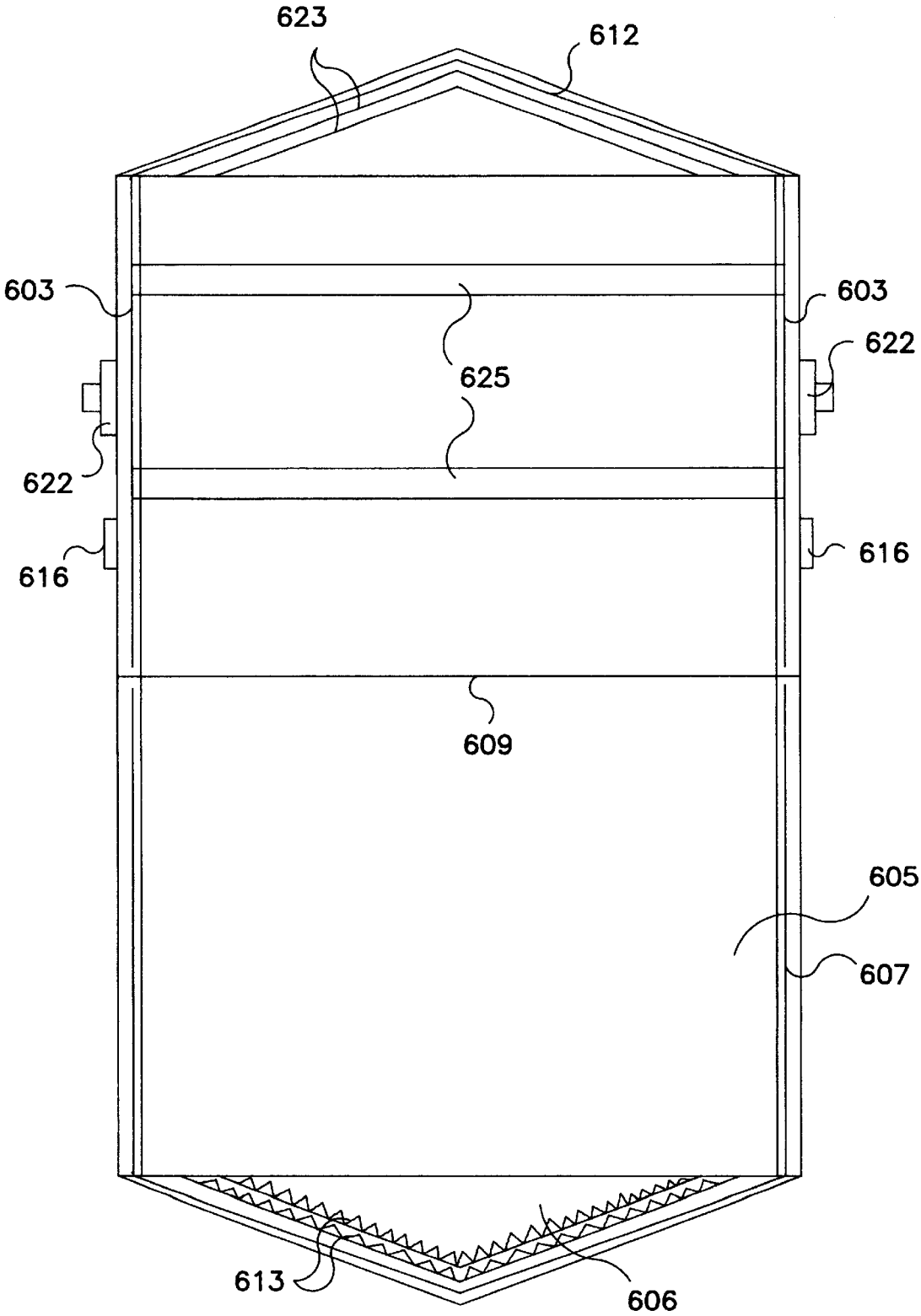
FIG. 7: is a top planar view of a preferred embodiment having a flip-top lid shown in an open position.
Figure 8A:
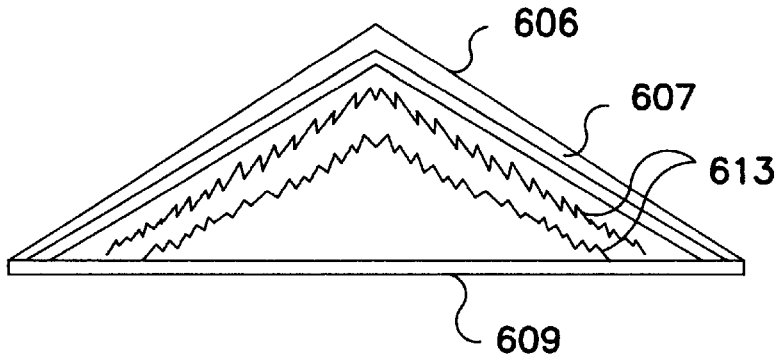
FIG. 8*a*: shows a preferred embodiment of a first portion of the sealing mechanism.

As shown in FIG. 8*a*, upper lip 606 (FIG. 6*b*) and lower lip 611 (FIG. 6*b*) may be "V" shaped in relation to the longitudinal axis of housing 600 (FIG. 6*b*). In this case, the towelettes are preferably perforated in corresponding "V" shaped patterns. As also shown in FIG. 8*a*, upper lip 606 also preferably includes teeth 613, preferably two rows of very fine soft plastic teeth facing away from the dispenser 600, i.e. in the direction of the exiting towelettes to prevent the towelettes from receding or traveling back into the dispenser 600. Teeth 613 may be formed through any of a number of techniques known in the art, such as injection molding or by cutting nicks into a soft material similar to that used to form the seal blade. Lower lip 611 (FIG. 7) may further include grooves 623 (FIG. 7) for receiving teeth 613.

Figure 8B:
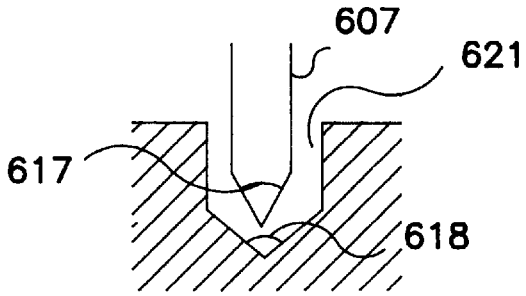
FIG. 8*b*: shows the sealing blade and grooved slot for receiving the blade.

With reference to FIG. 8*b*, the sealing blade 607, panel grooves 603 (FIG. 6*b*) and recessed groove 612 (FIG. 6*b*) (603 and 612 being shown collectively as 621 in FIG. 8*b*) and will now be described. In a preferred embodiment, grooves 603 and recessed groove 612 will not necessarily be identically shaped. Recessed groove 612 should be formed to allow exit blade 607*b* (FIG. 6*b*) to close upon the towelette protruding from the slot formed by upper lip 606 (FIG. 6*b*) and lower lip 611 (FIG. 6*b*). Panel grooves 603, however, do not have to accommodate a towelette and may be shaped accordingly. Side blade 607*a* (FIG. 6*b*) may also be differently shaped and/or comprise different material along the upper lip 606 and semi-circular edges 615 (FIG. 6*b*) to account for the presence of the towelette in the recessed groove or the lack thereof in the panel grooves. Alternately, side blade 607*a* and exit blade 607*b* may be formed from separate, non-integral members having different shapes and compositions. In the preferred embodiment, the size and shape of the blade 607 (607*a* and 607*b*) will differ from the shape of the panel grooves 603 and recessed groove 612 to create a better seal. Panel grooves 603 may be minimally larger than side blades 607*a* for easing opening and closing action with the point of the blade to be duller, to allow for a better seal. Also, the angle 617 of the blade 607 may differ from the angle 618 of the panel grooves 603 and recessed groove 612. This is particularly helpful for recessed grooves 612 which must accommodate the presence of the towelettes. In the preferred embodiment the exit blade 607*b* will be approximately ¼ inches high, while recessed slot 612 will be approximately 1/64 inches deep (i.e. the approximate width of a towelette) to allow for the pressure exerted by exit blade 607*b* on the towelettes. The exact size and shapes of each will depend upon the material chosen for the various parts of the sealing blade 607. Side panels 602 may further include a mechanism for securely closing lid 605, such as raised areas 619 along the interior of the panels 602 to clip into recessed portions 620 on either side of lid 605. Other mechanisms for securely snapping a lid shut will be known to those of ordinary skill in the art based on the disclosure herein.

Figure 8C:
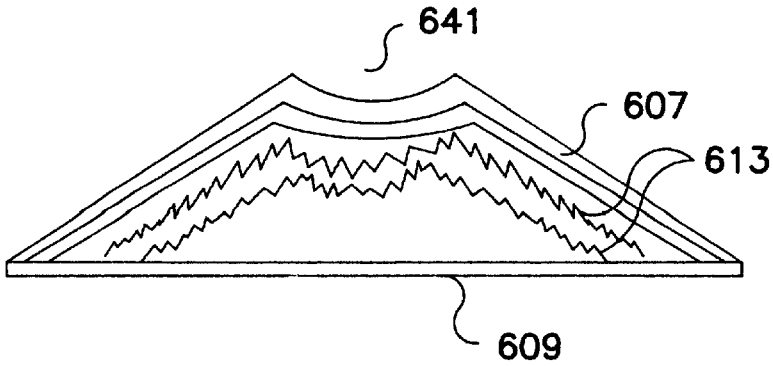
FIG. 8*c*: shows an alternate embodiment of a first portion of the sealing mechanism.

FIG. 8*c* shows an alternate embodiment in which the "V" shaped upper lip 606 (FIG. 6*b*) and lower lip 611 (FIG. 6*b*) may have a small cut-away section 641 which allows a user to leave a small, thumb-sized piece of tissue exposed to pull on the sheet. The preferred tissue paper for this configuration will continue to utilize "V" patterned perforations.

With reference to FIG. 7, a top planar view of a preferred embodiment having a flip-top lid 605 in an open position is shown. As shown, one or more sets of rollers 625 may be provided for guiding the role of towelettes. Alternatively, the sealing blade 607 running along the semi-circular edges 615 of the flip-top lid 605 and panel grooves may comprise snap close seals, such as is commonly used in plastic food storage containers.

The preferred wet towelette roll 15 of this invention will now be described. The roll 15 preferably contains a plurality of pre-moistened towelettes attached to one another by a transverse perforated line. The towelettes are ideally both flushable and biodegradable. One preferred towelette composition for this invention is the "WET WIPES" type composition employed by Scott Paper Company. This composition is known to consist of continuous webs of soft fibrous material adhered to a thermoplastic reinforcing layer in selected spaced regions comprising from between about 3% to about 25% of the surface area of the reinforcing layer. The webs hold moisture in an amount of from about 100 to about 300 wt. % based on the dry weight of fibers in the webs. The preferred towelettes of this invention can be biodegradable, especially within a sanitary sewer or landfill, flushable, and hypoallergenic. They can be medicated, for example, with a hemorrhoidal medicine, or anti-bacterial agent, provided with a lubricant, such as mineral oil, and/or a moisturizer, such as lanolin or aloe, just to name a few.

From the foregoing, it will be understood that this invention provides towelette dispensers for single and dual purpose use. The dispensers of this invention can be mounted in existing brackets without significantly interfering with other fixtures or requiring often non-existent bathroom, kitchen or other shelf space. It is envisioned that the towelettes of this invention will be easier for consumers to accept, since the operation of the dispenser is substantially similar to the typical motion of unwinding tissues from a dry tissue roll.

Although various embodiments have been illustrated, this was for the purpose of describing, and not limiting the invention. Various modifications will become apparent to one skilled in the art, and are considered within the scope of the attached claims.

What is claimed is:

1. A pre-moistened towelette dispenser for dispensing individual towelettes from a plurality of towelettes wrapped to form a roll, said dispenser comprising:

a housing having an elongated interior compartment for holding said roll in a substantially horizontal position during use;

a slotted horizontal opening disposed axially along said housing for permitting the removal of said individual towelettes from said dispenser, at least one of said towelettes being positioned in said slotted opening when said dispenser has been placed in use, said slotted opening having a first horizontal edge and a second horizontal edge;

teeth positioned along at least one of said first horizontal edge and said second horizontal edge, said teeth being biased against said at least one towelette positioned in said slotted opening to prevent said towelette from receding back into said interior compartment;

a sealing blade positioned along said first horizontal edge of said slotted opening, said blade being disposed to allow said towelettes to be removed from said dispenser through said slotted horizontal opening and pressing said at least one towelette positioned in said slotted horizontal opening against said second horizontal edge, whereby said blade substantially seals said interior compartment;

a groove disposed along said second horizontal edge to receive said blade; and a serrated edge adjacent to at least one of said first horizontal edge and said second horizontal edge, said serrated edge facilitating the separation of said towelettes.

2. The pre-moistened towelette dispenser of claim 1 wherein said groove is approximately the thickness of said individual towelettes.

3. The pre-moistened towelette dispenser of claim 1 wherein said first horizontal edge and said second horizontal edge of said slotted horizontal opening are formed by a first horizontal lip and a second horizontal lip, said first and second horizontal lips protruding from said housing.

4. The pre-moistened towelette dispenser of claim 3 wherein said first horizontal lip and said second horizontal lip protrude in a "V" shape in relation to a longitudinal axis of said housing.

5. The pre-moistened dispenser of claim 1 wherein said second horizontal edge of said lower portion is hinged to said second horizontal edge of said lid, whereby said lid may be flipped open to allow replacement of said roll of towelettes.

6. The pre-moistened towelette dispenser of claim 1 wherein said housing comprises:

a cylindrically shaped lower portion having a first horizontal edge forming said second horizontal edge of said slotted opening and a second horizontal edge; and a cylindrically shaped lid having a first horizontal edge forming said first horizontal edge of said slotted opening and a second horizontal edge hinged to said second horizontal edge of said lower portion, whereby said lid may be reopened to replace said roll of towelettes, wherein said first horizontal edge of said lower portion includes a horizontal lip protruding from said lower portion and said first horizontal edge of said lid includes a horizontal lip protruding from said cylindrically shaped lid.

7. The pre-moistened towelette dispenser of claim 6 wherein said horizontal lip of said lower portion and said horizontal lip of said flip-top lid protrude in a "V" shape in relation to a longitudinal axis of said housing.

8. The pre-moistened dispensor of claim 6 wherein a groove is disposed along said horizontal lip of said lower portion to receive said sealing blade.

9. The pre-moistened dispenser of claim 8 wherein said groove is approximately the thickness of said individual towelettes.

10. The pre-moistened dispenser of claim 6 further comprising a serrated edge adjacent said horizontal lip of said flip-top lid said serrated edge facilitating the separation of said towelettes.

11. The pre-moistened dispenser of claim 6 further comprising at least one row of teeth positioned along said horizontal lip of said flip-top lid, said teeth being biased against said at least one towelette positioned in said opening to prevent said towelette from receding back into said interior compartment.

12. The pre-moistened dispensor of claim 6 wherein said cylindrically shaped lower portion has a first vertical panel and a second vertical panel, said first vertical panel and said second vertical panel each having a top edge with a panel groove;

said lid having a first semicircular edge and a second semicircular edge, said lid having a pair of edge seal blades disposed along said semicircular edges, whereby said edge seal blades are positioned within said panel grooves when said lid is closed to substantially seal said interior compartment.

* * * * *